US008272375B1

(12) United States Patent
Bourgeois et al.

(10) Patent No.: US 8,272,375 B1
(45) Date of Patent: Sep. 25, 2012

(54) BACKPACKING STOVE POT AND APPARATUS

(76) Inventors: Norman Bourgeois, Jefferson, LA (US); Michael P. Bourgeois, Kenner, LA (US)

( * ) Notice: Subject to any disclaimer, the term of this patent is extended or adjusted under 35 U.S.C. 154(b) by 0 days.

(21) Appl. No.: 13/215,549

(22) Filed: Aug. 23, 2011

Related U.S. Application Data

(63) Continuation of application No. 12/014,900, filed on Jan. 16, 2008, now Pat. No. 8,001,955.

(60) Provisional application No. 60/885,063, filed on Jan. 16, 2007.

(51) Int. Cl.
*F24C 5/20* (2006.01)

(52) U.S. Cl. ..... 126/37 R; 126/9 R; 126/38; 126/30; 126/40; 126/50

(58) Field of Classification Search ..... 126/9 R, 126/9 B, 30, 40, 50, 37 R, 37 A, 37 B, 38
See application file for complete search history.

(56) References Cited

U.S. PATENT DOCUMENTS 3,277,880 A 10/1966 Kirby
7,703,386 B1 * 4/2010 Bourgeois et al. ..... 99/340
8,001,955 B1 8/2011 Bourgeois et al.

* cited by examiner

*Primary Examiner* — Alfred Basichas
(74) *Attorney, Agent, or Firm* — Garvey, Smith, Nehrbass & North, L.L.C.; Charles C. Garvey, Jr.; Vanessa M. D'Souza

(57) ABSTRACT

A stove and pot arrangement is provided that affords utility to backpackers and other users having limited space. The apparatus provides a specially configured stove frame having laterally spaced apart channels that are receptive of the pot rim and wall and wherein the pot interior is receptive of a central portion of the frame, the pot and frame having about the same overall height.

18 Claims, 8 Drawing Sheets

BACKPACKING STOVE POT AND APPARATUS

CROSS-REFERENCE TO RELATED APPLICATIONS

This is a continuation of U.S. patent application Ser. No. 12/014,900, filed Jan. 16, 2008 (now U.S. Pat. No. 8,001,955, issued on Aug. 23, 2011), which is a nonprovisional of U.S. Provisional Patent Application Ser. No. 60/885,063, filed Jan. 16, 2007, each of which are incorporated herein by reference.

Priority of U.S. Provisional Patent Application Ser. No. 60/885,063, filed Jan. 16, 2007, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to portable stoves that are adapted to backpacking activities. More particularly, the present invention relates to an improved stove with nested pot arrangement wherein a specially configured frame has flanged side portions that form legs and wherein recesses accept a portion of the wall of the pot, a burner element being supported upon the frame, the burner element being nested within the confines of the pot when in a storage position.

2. General Background of the Invention

Backpacking stoves are known that occupy very little space. However, most of these stoves generate a small amount of heat so that they are restricted to light cooking activity such as boiling water, frying eggs, frying bacon, or like food items. A need exists for a more robust yet portable stove arrangement that can cook larger quantities of food in a relatively large pot having a diameter that approaches the length and/or width of the stove and which can accept optional accessories such as an oven cabinet or smoker cabinet.

Many stoves are powered with commercially available containers of gaseous fuel. Such stoves are typically very large and too bulky to be used for backpacking purposes. Such stoves typically are not adapted to form a nested arrangement with a very large pot wherein the diameter of the pot approaches or is larger than one of the length or width dimensions of the stove frame.

BRIEF SUMMARY OF THE INVENTION

The present invention provides an improved portable stove and pot apparatus. The apparatus features a frame that has upper and lower surfaces, the frame including a pair of spaced apart channel members connected by a central plate section.

Each channel member includes a horizontally extending web, a long flange and a short flange.

Each short flange provides a connection between a web and the central plate section.

A pair of opposed recesses are provided on the lower surface of the frame, each recess being defined by the web and flanges of the channels.

A pot is provided that nests with the frame. The pot provides a sidewall and a bottom. The sidewall has a pot rim spaced away from the bottom that fits the recesses, wherein the rim engages the web and the sidewall occupies a position in between the flanges of each channel member.

The pot sidewall has a height that is preferably slightly larger than the length of the longer flange.

The pot and burner apparatus can provide one or more removable grate members that attach to the frame upper surface.

The grate member or members can each connect to the frame at diagonally opposing corners of the frame.

The apparatus of the present invention is adapted to accept optional cabinets such as a smoker cabinet or oven cabinet that fits the upper surface of the frame.

Each of the grate members can provide a retainer that restrains the pot from substantial lateral movement when the pot is in a cooking position upon the grate members and above the burner element.

The smoker cabinet has upper and lower end portions, a front door that enables access to a majority of the front area of the cabinet and a side door near the lower end of the cabinet.

The cabinet can provide opposed slides at the lower end portion of the cabinet that are receptive of one or more trays such as a wood chips tray and/or a water containing tray.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
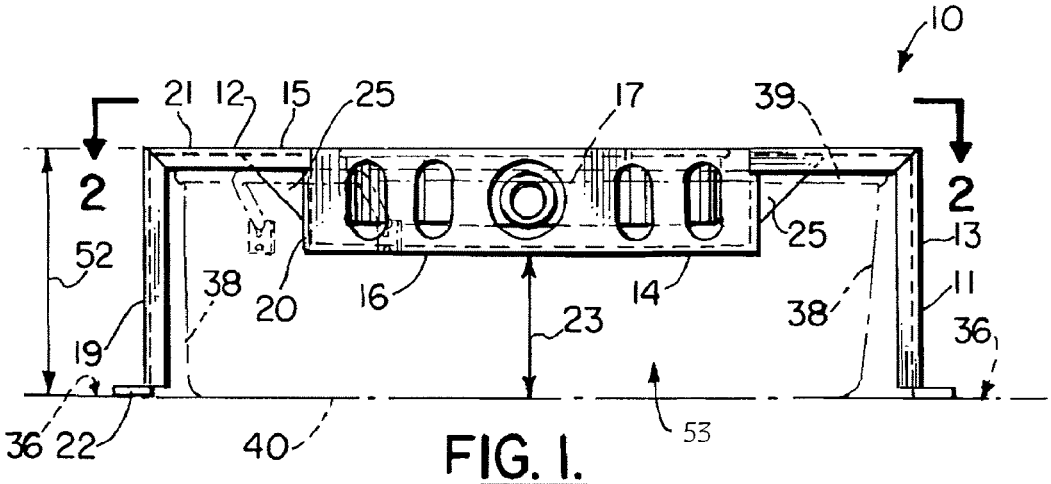
FIG. 1 is an elevation view of a preferred embodiment of the apparatus of the present invention.

FIGS. 1-3 and 9-10 show the preferred embodiment of the apparatus of the present invention, designated generally by the numeral 10. Stove and nested pot apparatus 10 provides a frame 11 that includes channel members 12, 13 and central plate 14. During transport, pot 40 nests in provided recesses of frame 11 as will be discussed more fully hereinafter. When cooking, pot 40 rests upon grate members 29, 30 and is spaced above a burner element 17.

Frame 11 has upper surface area 15 and lower surface area 16. Burner element 17 is mounted to plate 14 at upper surface area 15. A gaseous fuel inlet fitting 18 is provided on burner element 17 for enabling a connection to be made between an available gas containing cylinder or fuel canister and burner element 17. Such cylinders are known and are commercially available, sold under the Coleman® mark, for example.

Each channel member 12, 13 includes a long flange 19, short flange 20 and web 21. The long flange 19 has a foot (see FIG. 3) for engaging an underlying support surface such as a concrete floor or hard packed or rock earthen surface. In the drawings, the clearance arrow 23 indicates the clearance between central plate 14 and an underlying support surface 36 (e.g. concrete floor or packed earth). A recess 24 is provided in between each of the flanges 19, 20 (see FIG. 3). Gussets 25, 26 can be provided for stiffening the connection between each short flange 20 and web 21. Front wall 46 extends upwardly from central plate section 14 and is connected to (e.g. welded) short flanges 20 of channel members 12, 13 (see FIGS. 1-2 and 7-8). Central plate section 14 provides one or more ventilation openings 51.

A concavity 35 is defined by the central plate 14 and the short flanges 20 of the spaced apart channel members 12, 13. Concavity 35 is provided for holding burner element 17. The burner element 17 is preferably a gaseous fuel fired burner element that is mounted to the upper surface area 15 of the central plate section 14, within the concavity.

Front wall 46 has an aperture 47 for receiving gas inlet fitting 18 of burner element 17. Front wall 46 has ventilation openings 48. Rear wall 49 extends upwardly from central plate 14 and connects to short flanges 20 of channel members 12, 13. Rear wall 49 has ventilation openings 50.

Figure 4:
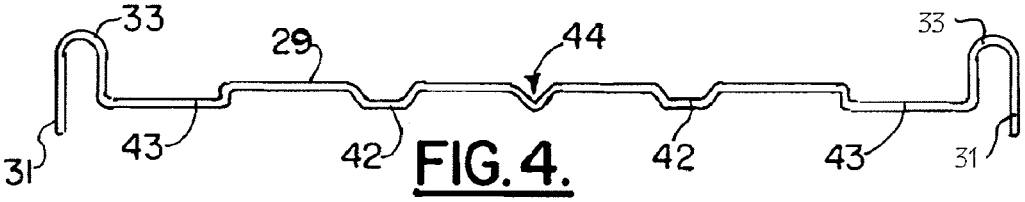
FIG. 4 is a fragmentary view of a preferred embodiment of the apparatus of the present invention.
Figure 5:
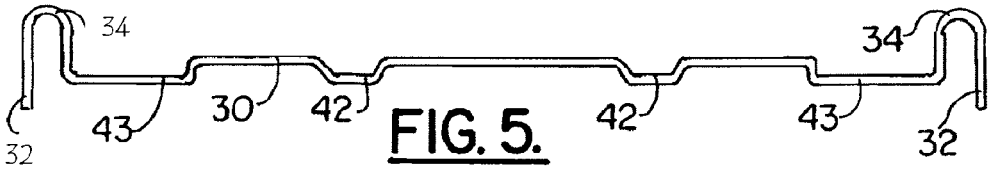
FIG. 5 is a fragmentary view of a preferred embodiment of the apparatus of the present invention.
Figure 6:
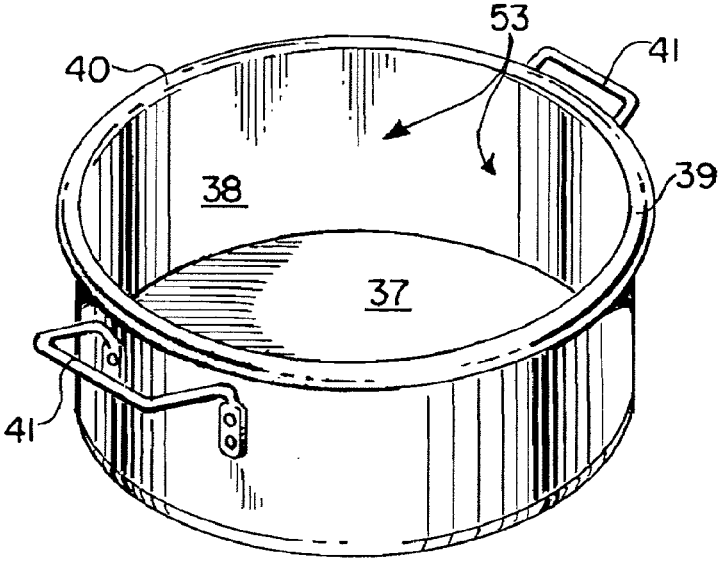
FIG. 6 is a partial perspective view of the pot portion of a preferred embodiment of the apparatus of the present invention shown removed from the burner frame.
Figure 7:
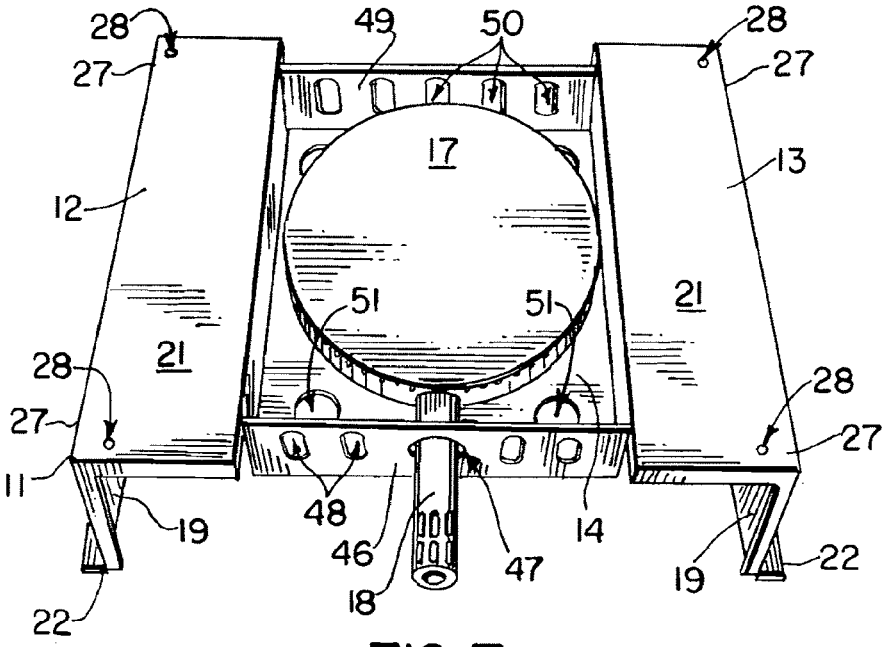
FIG. 7 is a perspective front view of a preferred embodiment of the apparatus of the present invention.
Figure 8:
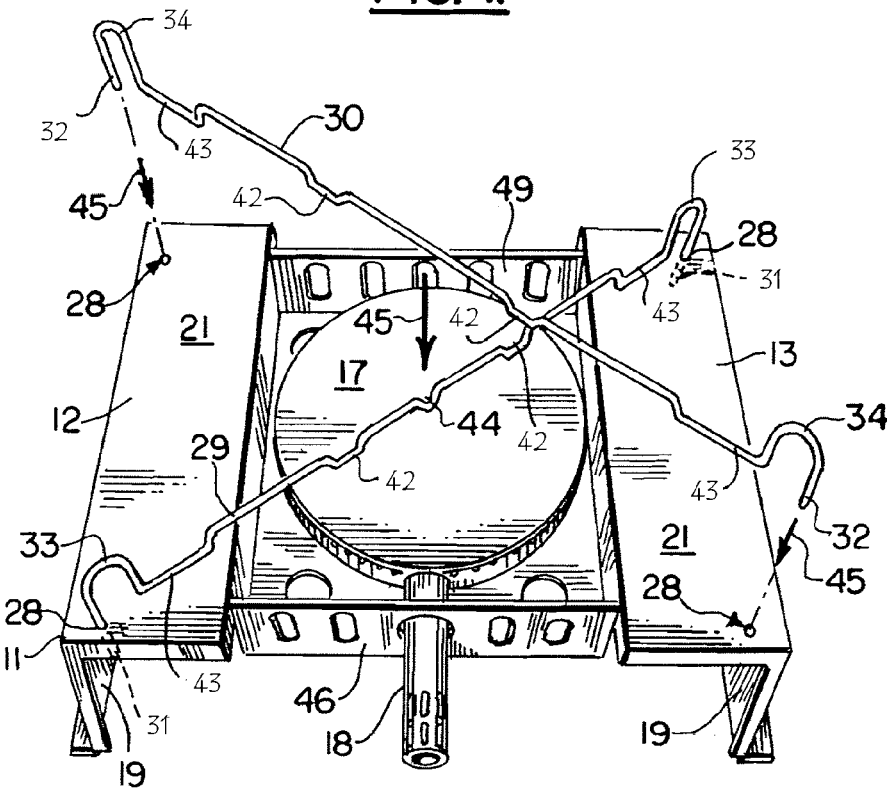
FIG. 8 is a perspective front view of a preferred embodiment of the apparatus of the present invention illustrating an addition of the removable grate members to the burner frame.
Figure 9:
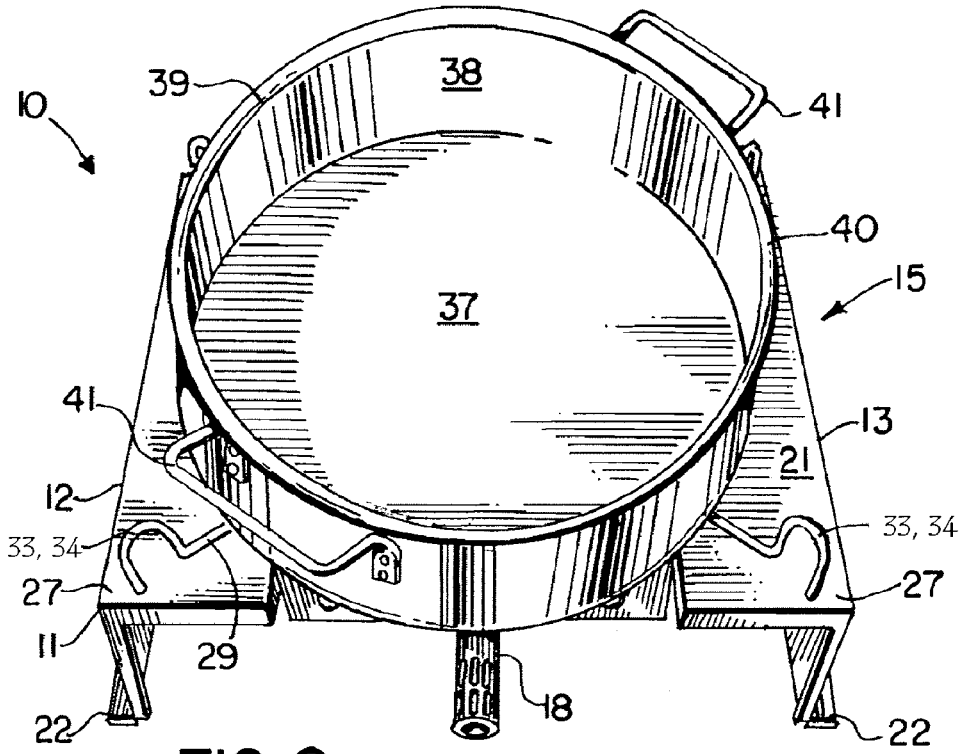
FIG. 9 is a perspective view of a preferred embodiment of the apparatus of the present invention.
Figure 10:
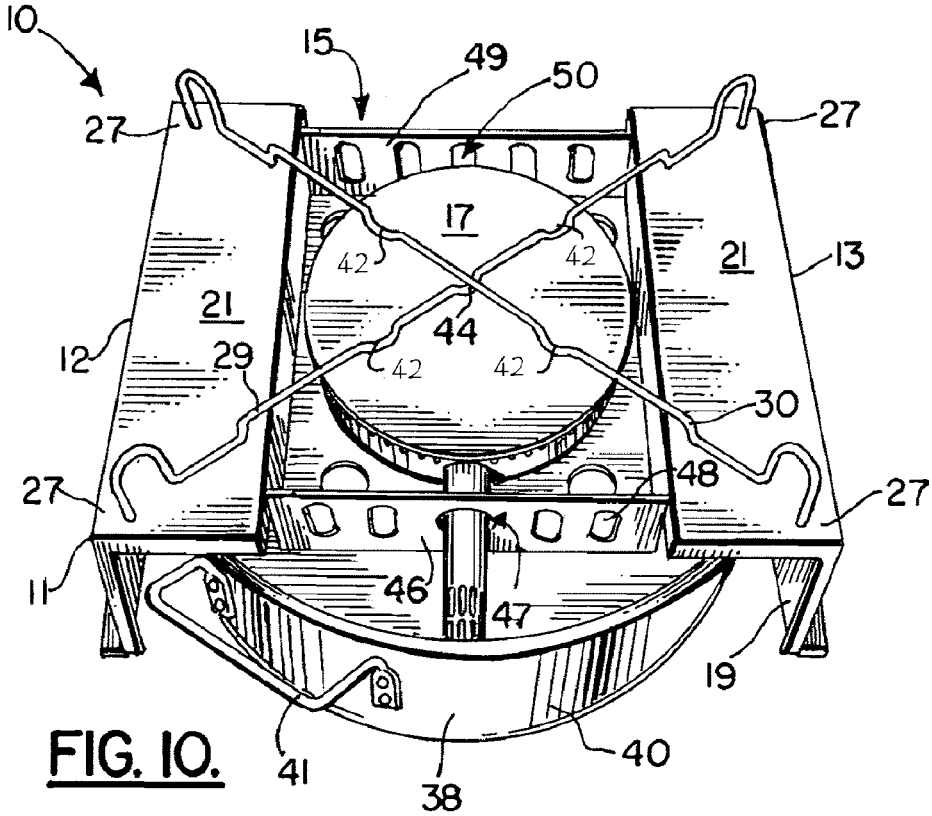
FIG. 10 is a perspective view of a preferred embodiment of the apparatus of the present invention illustrating the pot and burner frame in the stored position.

The frame 11 provides a plurality of corners 27. In the preferred embodiment, each corner 27 can be provided with an aperture 28 that is receptive of a grate member 29, 30 (see FIGS. 4-5 and 8-10). In FIGS. 4-5, each grate member 29, 30 has spaced apart feet 42, 43 that rest upon a web 21 (outer feet 43) or upon burner element 17 (inner feet 42) as shown in FIGS. 8 and 10. Concavity 44 on grate member 29 is receptive of grate member 30 at a position where the grate members 29, 30 intersect (see FIG. 10).

Each grate member 29, 30 preferably has a projection 31, 32 at its opposing end portions as shown. These projections 31, 32 fit the apertures 28 of diagonally opposed corners 27 (see arrows 45, FIG. 8). Each grate member 29, 30 has projecting portions that define pot retainers 33, 34. When two of the grate members 29, 30 are connected to frame 11 at apertures 28, a plurality of four pot retainers 33, 34 are provided for restraining pot 40 from excess lateral movement during cooking (see FIG. 9), thus generally centering pot 40 over burner element 17.

Figure 2:
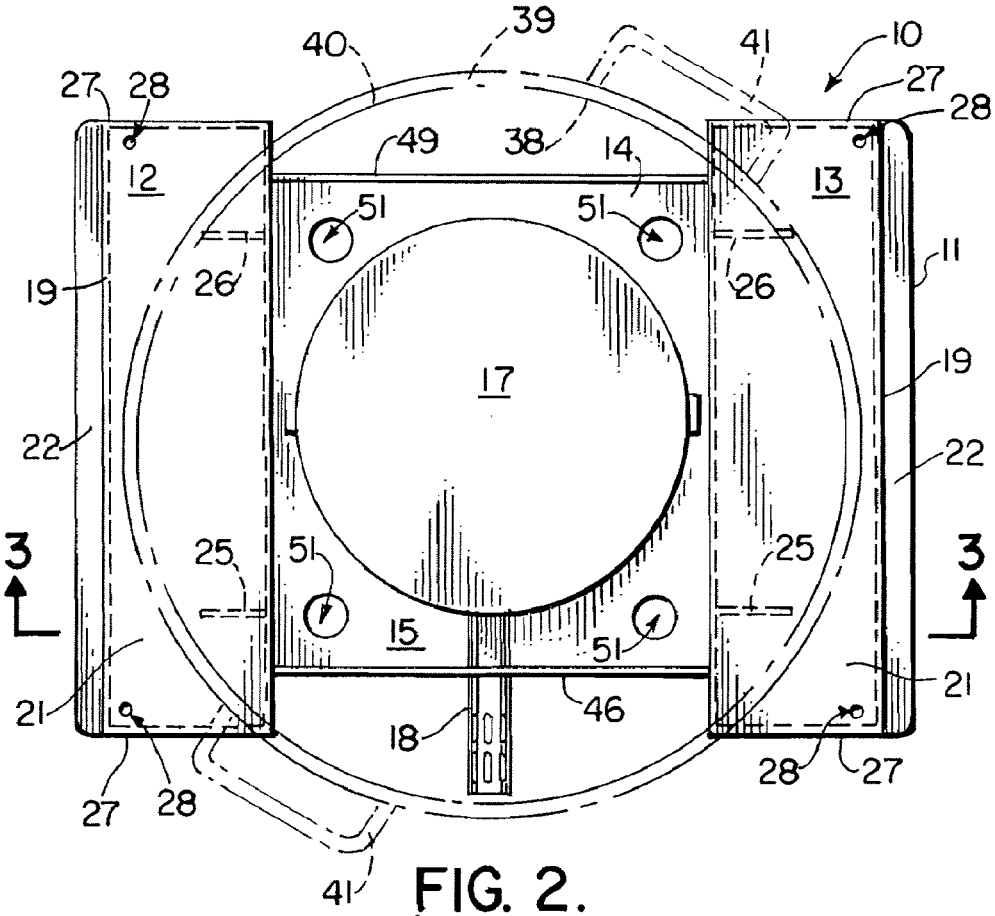
FIG. 2 is a top view of a preferred embodiment of the apparatus of the present invention taken along lines 2-2 of FIG. 1.
Figure 3:
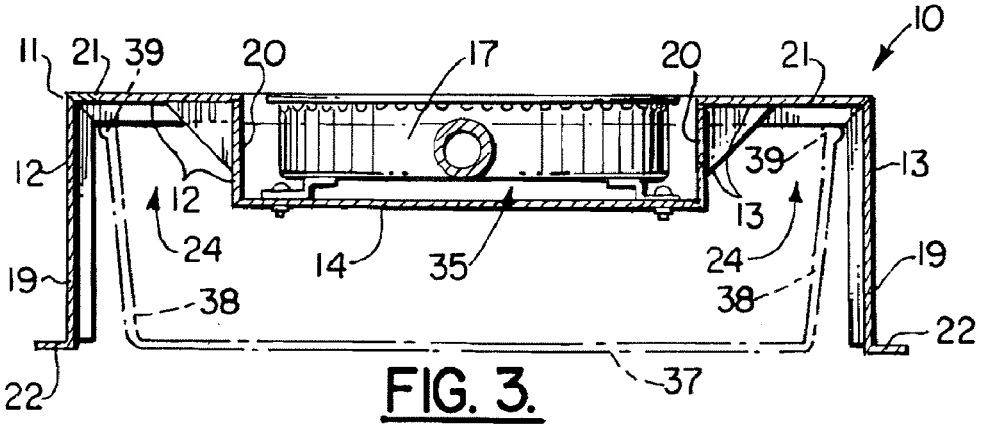
FIG. 3 is an elevation view of a preferred embodiment of the apparatus of the present invention taken along lines 3-3 of FIG. 2.

Pot 40 and burner frame 11 nest together for storage such as when occupying the interior of a user's backpack. FIGS. 1, 2 and 3 show the storage position of pot 40 relative to burner frame 11. Notice in FIG. 1 that the height of pot 40 is about equal to the clearance provided below web 21 of channel members 12, 13. In FIG. 1, dimension arrow 52 is the height of pot 40 and also the clearance between underlying support surface 36 and the bottom of webs 21 of channel members 12, 13. In FIG. 1, the burner element 17 thus extends into the pot interior 53 i.e., that area that is below pot rim 39 and above pot bottom 37 and surrounded by pot side wall 38. Pot 40 may optionally have handles 41. Similarly, burner frame central plate 16 is positioned within pot 40 interior 53 in the storage position of FIGS. 1-3. Additionally, at least a portion of the short flanges 20 of channel members 12, 13 is positioned within the interior 53 of pot 40 in the storage position. FIG. 9 shows the cooking position with pot 40 resting upon grate members 29, 30.

Figure 11:
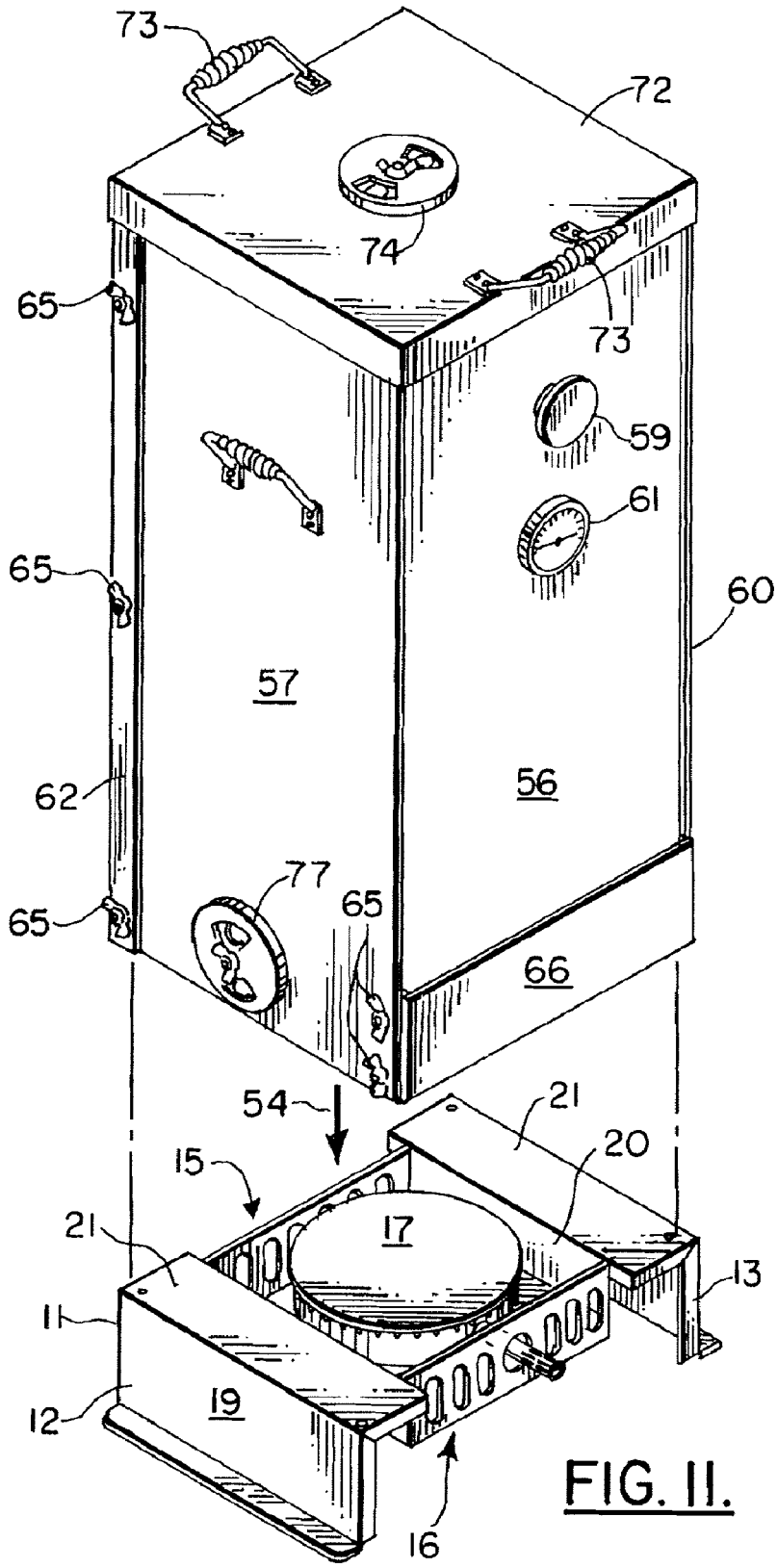
FIG. 11 is a perspective exploded view of a preferred embodiment of the apparatus of the present invention illustrating the burner frame and optional or auxiliary cabinet.
Figure 12:
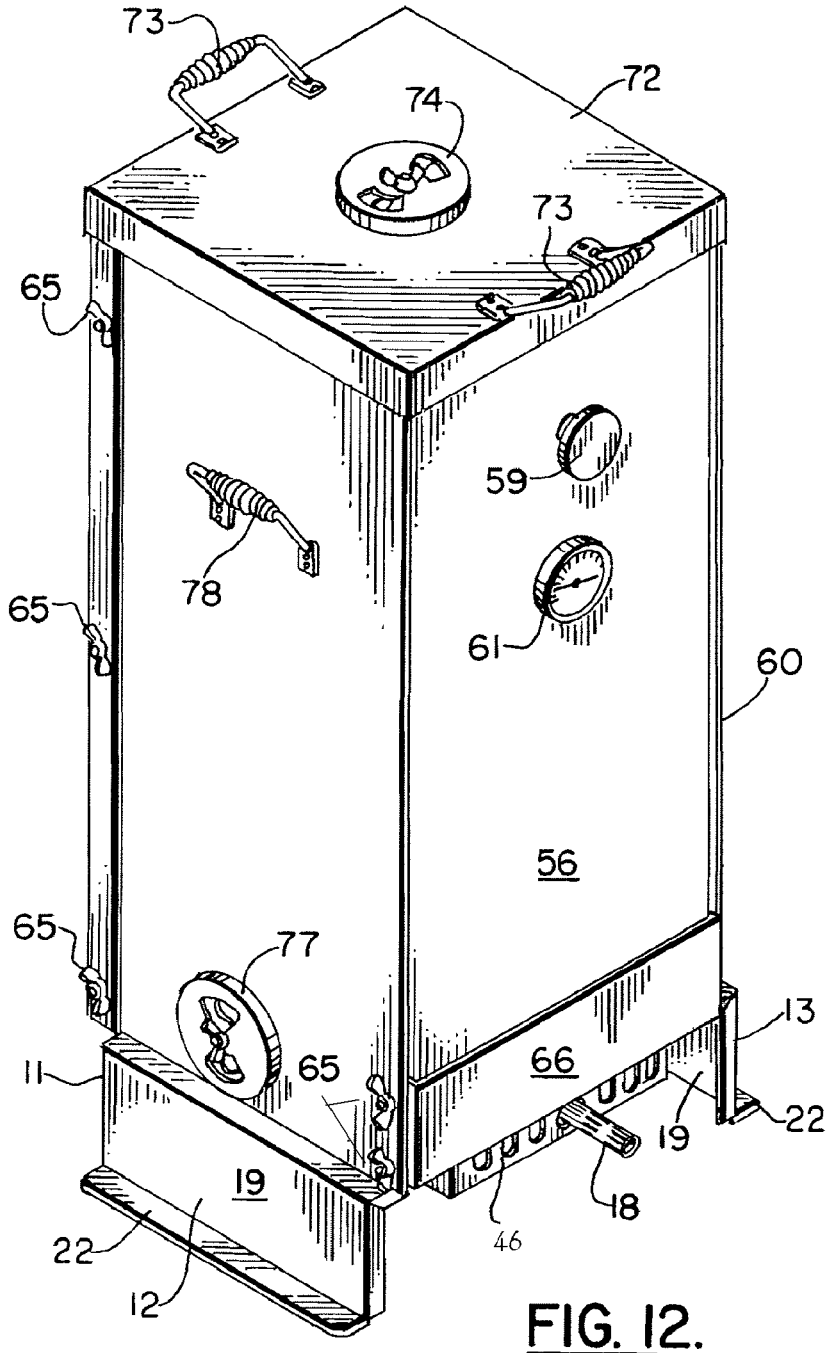
FIG. 12 is a perspective view of a preferred embodiment of the apparatus of the present invention illustrating the optional cabinet in an operating position upon the burner frame.

Burner frame 11 optionally accepts a cabinet (e.g. smoker or oven) 60 which can be placed upon the webs 21 of channel members 12, 13 as indicated schematically by arrow 54 in FIG. 11. FIG. 12 shows smoker or oven cabinet 60 placed in an operating, cooking position upon frame 11. Smoker or oven cabinet 60 is designed to be completely and quickly disassembled, its parts being stacked together for easy transport such as in a flat bag or container or within the backpack of a user.

Figure 13:
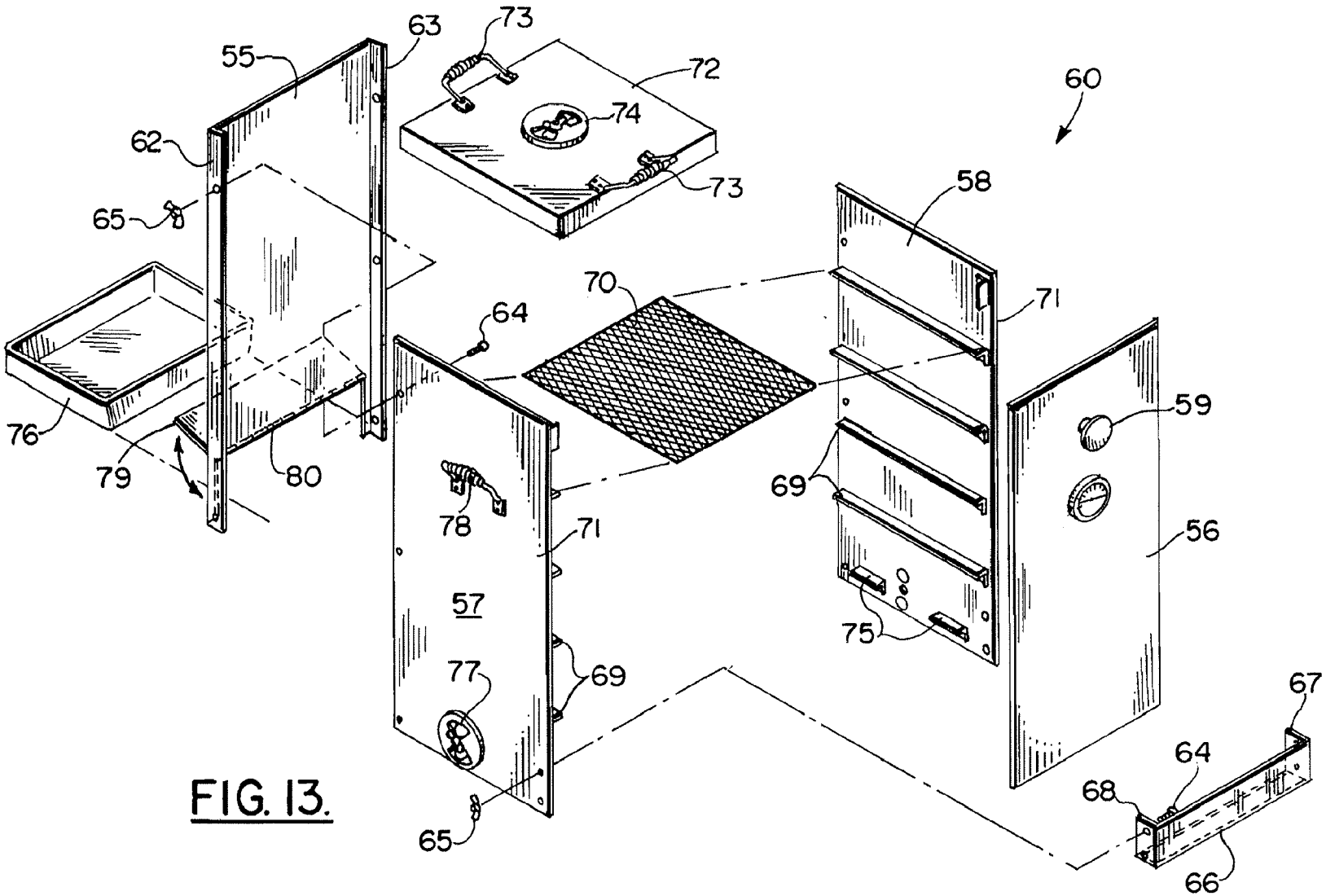
FIG. 13 is a partial perspective exploded view of a preferred embodiment of the apparatus of the present invention illustrating the cabinet.

As shown in FIGS. 11-13, the smoker or oven cabinet 60 includes a rear wall 55, front wall 56 and side walls 57, 58. The front wall 56 functions as a door that is removable during cooking so that a user can access the interior of the smoker or oven 60 to place or remove food items. In that regard, front wall 56 can be provided with a handle 59 that enables a user to grasp the handle 59 when manipulating front wall 56.

Rear wall 55 provides opposed flanges 62, 63 that are provided with apertures for enabling the side walls 57, 58 to be bolted to the rear wall 55 at the flanges 62, 63. A bolted connection 64 can employ wing nuts 65 for speed. Side walls 57, 58 are provided with a plurality of openings that enable a bolted connection to be formed with rear wall 55. Apertures are also provided in side walls 57, 58 for enabling a bolted connection to be made with bracket 66.

Bracket 66 provides flanges 67, 68 that are connectable to side panels 57, 58 using bolted connections 64 for example. Each side panel has a plurality of shelf holders 69 that enable one or more shelves 70 to be supported at intervals (see FIG. 15). The shelf holders 69 are also spaced rearwardly a small distance (e.g. ¼") from the forward edge 71 of each side wall 57, 58. The shelf holders 69 thus help support front panel 56 in its operating position as shown in FIG. 11, wherein the front wall 56 is placed behind bracket 66 and in front of the shelf holder 69.

Figure 15:
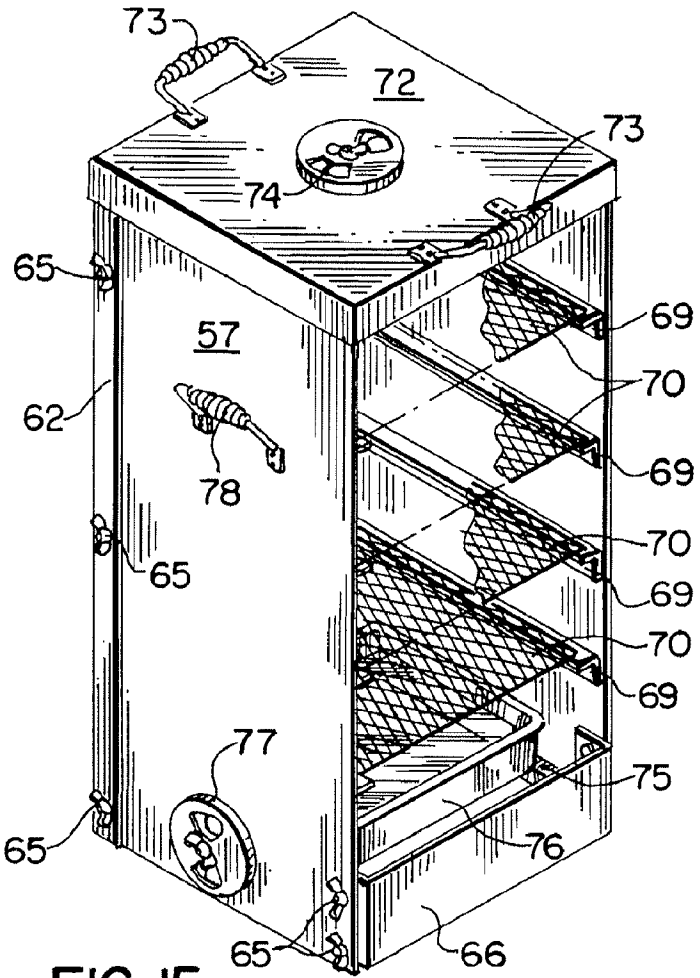
FIG. 15 is a partial perspective view of a preferred embodiment of the apparatus of the present invention illustrating the cabinet with front door removed for clarity.
Figure 14:
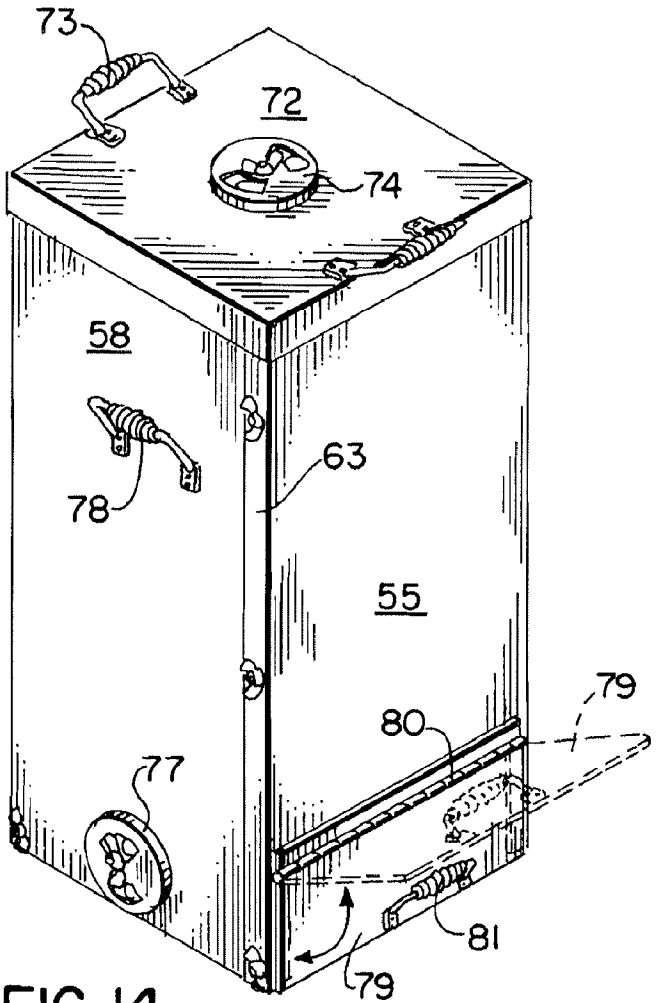
FIG. 14 is a perspective rear view of a preferred embodiment of the apparatus of the present invention illustrating the cabinet.

To retain front wall 56 in the operating, cooking position of FIGS. 12 and 14-15, lid 72 is placed over the combination of rear wall 56, side walls 57, 58 and front wall 56 as shown in FIG. 14. For manipulating lid 72, handles 73 can be provided. Lid 72 also provides a vent 74 that can be opened and closed during smoking or cooking.

Lower shelf holders 75 can be provided for supporting one or more pans 76, such as a water pan or wood chips pan. Side walls 57, 58 can optionally be provided with vents 77. Side walls 57, 58 are preferably provided with handles 78 that enable a user to place smoker or cabinet 60 upon frame 11 or to remove it.

Rear wall 55 can be provided with an access panel 79 that moves between open and closed positions by rotating upon hinge 80. Access panel 79 can be provided with handle 81. A thermometer 61 can be placed on front panel 56.

The following is a list of parts and materials suitable for use in the present invention.

PARTS LIST

| Part Number | Description |
|---|---|
| 10 | stove and nested pot apparatus |
| 11 | frame |
| 12 | channel member |
| 13 | channel member |
| 14 | central plate section |
| 15 | upper surface area |
| 16 | lower surface area |
| 17 | burner element |
| 18 | gaseous fuel inlet fitting |
| 19 | long flange |
| 20 | short flange |
| 21 | web |
| 22 | foot |
| 23 | clearance arrow |
| 24 | recess |
| 25 | gusset |
| 26 | gusset |
| 27 | corner |
| 28 | aperture |
| 29 | grate member |
| 30 | grate member |
| 31 | projection |
| 32 | projection |
| 33 | pot retainer |
| 34 | pot retainer |
| 35 | concavity |
| 36 | underlying support surface |
| 37 | pot bottom |
| 38 | pot wall |
| 39 | pot rim |
| 40 | pot |
| 41 | handle |
| 42 | inner foot |
| 43 | outer foot |
| 44 | concavity |
| 45 | arrow |
| 46 | front wall |
| 47 | aperture |
| 48 | ventilation opening |
| 49 | rear wall |
| 50 | ventilation opening |
| 51 | ventilation opening |
| 52 | arrow |
| 53 | pot interior |
| 54 | arrow |
| 55 | rear wall |
| 56 | front wall |
| 57 | side wall |
| 58 | side wall |
| 59 | handle |
| 60 | smoker or oven cabinet |
| 61 | thermometer |
| 62 | flange |
| 63 | flange |
| 64 | bolted connection |
| 65 | wing nut |
| 66 | bracket |
| 67 | flange |
| 68 | flange |
| 69 | shelf holder |
| 70 | shelf |
| 71 | front edge |
| 72 | lid |

-continued

PARTS LIST

| Part Number | Description |
|---|---|
| 73 | handles |
| 74 | vent |
| 75 | shelf holder |
| 76 | pan |
| 77 | vent |
| 78 | handle |
| 79 | access panel |
| 80 | hinge |
| 81 | handle |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A portable stove apparatus, comprising:

a) a frame that has upper and lower surfaces, the frame including a pair of spaced apart channel members connected by a central plate section having an upper surface;

b) each channel member including a web and a pair of spaced apart flanges, said flanges including, a long flange and a short flange;

c) each short flange providing a connection between a web and the central plate section;

d) a concavity that is defined by the central plate section and the short flanges of the spaced apart channel members;

e) a gaseous fuel fired burner element mounted to the central plate section;

f) a pair of opposed recesses on the lower surface of the frame, defined by the web and flanges of the channels;

g) a pot supporting one or more grate members that removably attaches to the frame upper surface; and h) a smoker cabinet that attaches to and extends above the frame.

2. The portable stove apparatus of claim 1, further comprising a pot that nests within the channel members wherein each grate member has retainers that restrain the pot from substantial lateral movement when the pot is in a cooling position on the grate members and above the burner element.

3. The portable stove apparatus of claim 1, further comprising a smoker cabinet that fits the upper surface of the frame.

4. The portable stove apparatus of claim 1, wherein the smoker cabinet has upper and lower end portions, a front door that enables access to a majority of a front area of the cabinet and a side door near the lower end of the cabinet.

5. The portable stove apparatus of claim 4, further comprising opposed slides at the lower end portion of the cabinet that are receptive of a tray.

6. The portable stove apparatus of claim 5, wherein the tray is a water tray.

7. The portable stove apparatus of claim 6, wherein the slides support two trays.

8. The portable stove apparatus of claim 7, wherein a second tray is below a first tray.

9. The portable stove apparatus of claim 1, wherein the cabinet has collapsible walls and a lid that is removable from the walls.

10. The portable stove apparatus of claim 1, further comprising a pot that is connectable to the frame in a storage position and wherein the frame has a length and a width, the pot has a diameter and the pot diameter is greater than the frame width so that part of the pot extends laterally beyond the frame in the storage position.

11. The portable stove apparatus of claim 1, further comprising one or more gussets that connect between the web and the flanges.

12. The portable stove apparatus of claim 1, further comprising a pot that is connectable to the frame in a storage position and wherein the frame has a height, the pot has a height, and the frame height is smaller than the pot height.

13. The portable stove apparatus of claim 1, wherein the long flanges of the channel members are legs that have lower end portions that engage an underlying support surface during cooking.

14. The portable stove of claim 1 further comprising a pot that is connectable to the frame in a storage position and wherein the pot has a bottom that is positioned below the burner element in the storage position.

15. The portable stove of claim 1 further comprising a fuel inlet fitting wherein the fuel inlet fitting does not extend into either of the channel members.

16. The portable stove of claim 1 further comprising a pot that is connectable to the frame in a storage position and wherein a part of the pot side wall occupies each channel member recess.

17. The portable stove of claim 16 wherein the central plate is contained entirely within the pot interior in the storage position.

18. The portable stove of claim 1 wherein grate members extend upwardly from the webs of the channel members.

* * * * *